United States Patent [19]

Schaeff

[11] 4,378,193

[45] Mar. 29, 1983

[54] MOBILE SHOVEL EXCAVATOR

[76] Inventor: Hans Schaeff, Postfach 20, Langenburg, 7183, Fed. Rep. of Germany

[21] Appl. No.: 267,357

[22] Filed: May 26, 1981

Related U.S. Application Data

[63] Continuation-in-part of Ser. No. 970,536, Dec. 18, 1978, abandoned.

[30] Foreign Application Priority Data

Dec. 24, 1977 [DE] Fed. Rep. of Germany ..... 2757968

[51] Int. Cl.[3] ..... E02F 3/32

[52] U.S. Cl. ..... 414/695; 414/687

[58] Field of Search ..... 414/687, 694, 695, 705, 414/722; 212/8 R, 8 B

[56] References Cited

U.S. PATENT DOCUMENTS

| | | | |
|---|---|---|---|
| 3,099,358 | 7/1963 | Clark | 414/695 X |
| 3,250,410 | 5/1966 | Dorkins | 414/695 |
| 3,669,286 | 6/1972 | Gauchet | 414/705 X |
| 3,703,973 | 11/1972 | Nilsson | 414/694 X |
| 3,712,490 | 1/1973 | Schaeff | 414/695 |
| 3,717,269 | 2/1973 | Schaeff | 414/694 |
| 4,049,139 | 9/1977 | Stedman | 414/695 X |

FOREIGN PATENT DOCUMENTS

| | | | |
|---|---|---|---|
| 1756261 | 4/1970 | Fed. Rep. of Germany | 414/694 |
| 2612879 | 9/1977 | Fed. Rep. of Germany | . |

*Primary Examiner*—Robert J. Spar
*Assistant Examiner*—Terrance L. Siemens
*Attorney, Agent, or Firm*—Schlesinger, Arkwright, Garvey and Dinsmore

[57] ABSTRACT

A mobile shovel excavator having a superstructure rotatable about a vertical axis on an undercarriage wherein the arc circumscribed by the rotating superstructure projects beyond the undercarriage, and a stump jib pivotable on the superstructure about a vertical pivot axis by means of a hydraulic cylinder is provided; an excavator jib is attached to the distal end of the stump jib, and the excavator jib is pivotable about the stump jib; in use, the stump jib may be pivoted so that the outer end thereof is either inside or outside of the arc circumscribed by this superstructure, thus varying the pivot point of the excavator jib, and when the excavator is not in use, both the stump jib and the excavator jib are entirely positioned within the arc circumscribed by the rotatable superstructure.

7 Claims, 8 Drawing Figures

MOBILE SHOVEL EXCAVATOR

CROSS REFERENCE TO RELATED APPLICATION

This application is a continuation-in-part of copending application Ser. No. 970,536 filed Dec. 18, 1978, now abandoned.

BACKGROUND AND OBJECTS

The invention relates to a mobile shovel excavator with a superstructure which rotates around a vertical axis on an undercarriage, whereby the arc of the pivoting superstructure projects over the side of the undercarriage, and whereby a stump jib pivots around a vertical pivot axis by means of a hydraulic cylinder which is articulated on the superstructure, and at the outer end is found a pivot support for the sideways pivot of a vertically pivoting excavator jib.

With a shovel excavator of this construction, known in German Patent No. 26 12 879, a filler element is provided between the vertical axis of an attachment holder found on the super structure and the rear of the shovel excavator jib, by the connection of which ditches can be made on the far side of obstacles projecting from the undercarriage, e.g. on the far side of guide boards, ditches and so forth. The filler element is pivotable at 45° angles to both sides from a middle setting on the longitudinal middle axis on the superstructure, with the aid of one single hydraulic cylinder.

The objective of the invention is to improve a mobile shovel excavator of the described known structure, such that the work members (digging tool, shovel arm, jib and stump jib) can be folded together in the narrowest possible space outside the field of view of the vehicle operator, and such that the center of gravity of the excavator is concentrated towards the middle of the superstructure.

This objective is attained in that stump jib is pivotable about approximately 90° from an end position which is essentially transverse to the longitudinal middle axis of the superstructure and is still within the arc of the superstructure. Also, a repository platform is provided on the superstructure on the side corresonding to said end position of the stump jib and from the opposite superstructual elements, on which platform the digging tool can be deposited with the excavation jib pivoted back parallel to the longitudinal axis of the superstructure.

By means of this proposal, with stump jib pivoted to its side end position and the excavator jib pivoted approximately 90° in the same direction, and by folding up of jib and shovel arm it is possible to accommodate these working members including the digging tool, within the arc subscribed by the superstructure, so that even with limited workspace, e.g. within a narrow alley, the excavated material carried in front of the excavator can be discharged on a cargo vehicle standing behind the excavator. In the travelling mode, the digging tool is lowered and tightened on the repository platform, after having sidewardly pivoted the stump jib and rearwardly pivoted the excavator jib, so that the working members, which afford a satisfactory range of action, are folded up compactly and are brought and accomodated within the arc circumscribed by the superstructure. As the stump jib at its maximum pivot angle extends essentially only to the longitudinal middle axis of the superstructure, and as the operator cab is arranged towards the side opposite to the stump jib's pivot range side, the view of the operator remains unobstructed both in the traveling operation and in the excavating operation. Particularly in driving the vehicle with the stump jib pivoted sideways, the view of the operator is not obscured by any of the working members, so that the excavator can be used in open streets within the legal regulations as a fast-moving vehicle, moving rapidly from one construction site to the next. Prerequisites for rapid street travel are met in that the weights of the different working members in their folded up state are efficient only within the arc of the superstructure and thereby bring the center of gravity into the middle of the superstructure. For pivoting the stump jib within a preferrably limited pivot angle of approximately 90°, one single simple hydraulic cylinder will suffice.

It is proposed that when the superstructure is set in direction of movement, the repository platform is found within the outside dimension to the side of the undercarriage. Thus the digging tool, by pivoting of the stump jib and of the excavator jib, can be so lowered on the repository platform and so arranged that it does not project sideways beyond the undercarriage. However, for discharge of excavated material when there is little space, the excavator jib need not be brought above the platform but will be pivoted just so far that the digging tool becomes located, with the excavated material still therein, within the arc circumscribed by the superstructure.

With one embodiment of the invention, the excavator jib, with the aid of a pivot mechanism consisting of two cylinders or a reversible motor, can be pivoted at the end of the stump jib around at least 90° relative to the longitudinal axis of said stump jib. Powered operation of the side pivot of the excavator jib is not absolutely required, since because of the unlimited pivotabiity of the superstructure, the desired digging positions can also be reached if the excavator jib remains tightly set at certain angular positions relative to the stump jib.

If, as is known with shovel excavators, the operation stand is found at the front and to one side of the superstructure, then in another construction of the invention, the pivot axis can be set on the stump jib attachment holder so far back in the arc that the sideways pivoted stump jib lies outside the clear view angle between the operator and the front end of the undercarriage. Because the operator has not only free view forward but also beyond the front end of the undercarriage, the view and also the maneuverability of the excavator is decidedly improved. Furthermore, a housing coping of a power unit housing, arranged between repository platform and operator cab, can be configured as an additional repository platform for excessively wide trenching tools. Thereby a wider digging shovel, which would project sideways over the support platform and also over the outside dimensions of the undercarriage, with an additional pivot of the excavator pivot of the excavator jib, goes further inward and then if the jib is raised, is let down on the housing coping. The repository platform can also be used as transporter for additional digging tools which the excavator carries along to its work place.

DESCRIPTION OF THE DRAWINGS

Further features and advantages of the invention are shown in the following description of one embodiment relative to the drawings.

DETAILED DESCRIPTION OF THE INVENTION

Figure 2:
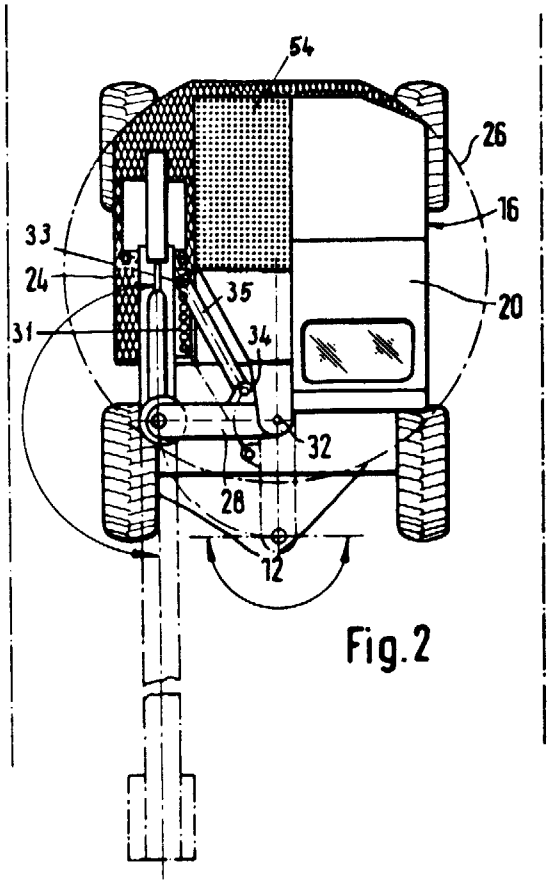
FIGS. 1 and 2 are plan views of two different embodiments of a shovel excavator with caterpillar track or wheels, with an arrangement of the work devices in folded up state.

On the caterpillar track 10 or wheel arrangement 12 of the excavator is provided a turntable 14 for mounting and pivot operation of the superstructure 16 for 360° around a vertical axis 18. On superstructure 16 are an operator cab 20, a counterweight and a housing carrying the operation tools, which are all indicated as 22, and a repository platform 24. The width of the superstructure 16 is, when lined up on the longitudinal middle axis of undercarriage 10, within the outside of the undercarriage, but superstructure 16 circumscribes an arc 26 around its axis 18. The sight angle of the operator in the cab 20 is designated $\alpha$.

A stump jib 28 is mounted on an attachment holder 30 of the superstructure, which pivots around a vertical axis 32. Attachment holder 30 is found within arc 26 and is set so far back that even stump jib 28 remains still within the arc in the end position shown in FIGS. 1 and 2. The length of stump jib 28 substantially covers the distance between pivot axis 32 and the longitudinal middle of the repository platform 24.

Figure 1:
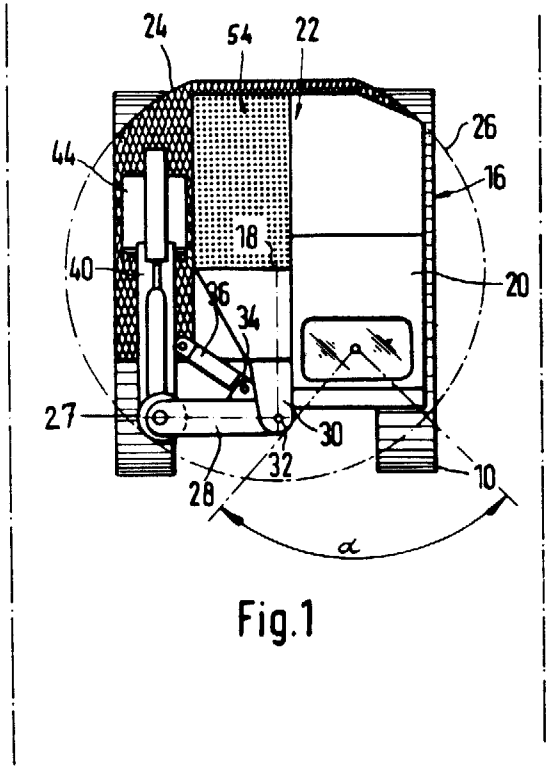
Figure 6:
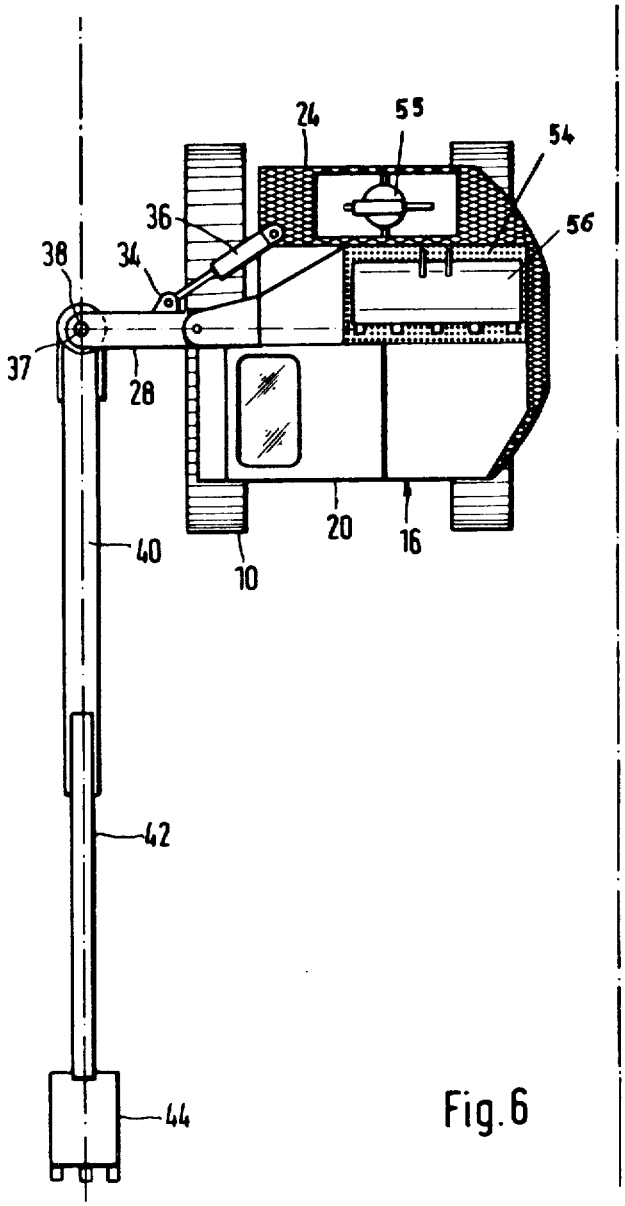
FIG. 6 is a plan view of the excavator of FIG. 1 in work position during formation of a ditch running sideways at some distance from the undercarriage.

Secured to one side of stump jib 28 is a mounting lug 34 to which is articulated one end of a hydraulic cylinder 36 shown in FIG. 1 and one end of a rod member 35, shown in FIG. 2, respectively. The other end of cylinder 36 is articulated to the superstructure 16. Hydraulic cylinder 36 is found in FIG. 1, in its retracted position, while FIG. 6 shows its extended end position, in which the stump jib runs parallel to the longitudinal middle axis of the superstructure. It is possible to increase the pivot angle of the stump jib, which is normally limited to approximately 90°, to approximately 135°, if a longer hydraulic cylinder or another pivot mechanism is used.

Alternatively, as shown in FIG. 2, hydraulic cylinder 36 may be replaced by a rod 35 having one end pivotally attached to lug 34. The other end of rod 35 is pivoted with a hole so that a locking pin 33 passing through the hole may be inserted into any one of a series of holes 31 to fix the angular relation between stump jib 28 and excavator 40.

At the front end of stump jib 28 a king post 38 is pivotably and adjustably supported about a vertical axis 37. The excavator jib 40 is hydraulically adjustable around a horizontal axis (not shown) on the king post 38 which as shown is pivoted by means of a reversible motor pivot mechanism relative to the longitudinal axis of stump jib 28 around at least 90° in either direction. The pivot mechanism can also consist of two hydraulic cylinders supported by articulation on the stump jib, or as is known, can be deleted completely, whereby the digging tool is then set on the ground and stump jib 28 is pivoted so far and often that excavator jib 40 reaches a position, which it is latched by a pinning arm on stump 28. At the front end of excavator jib 40 rests a hydraulically pivotable shovel arm 42, which supports a traditional digging tool, e.g. trenching shovel 44.

Figure 7:
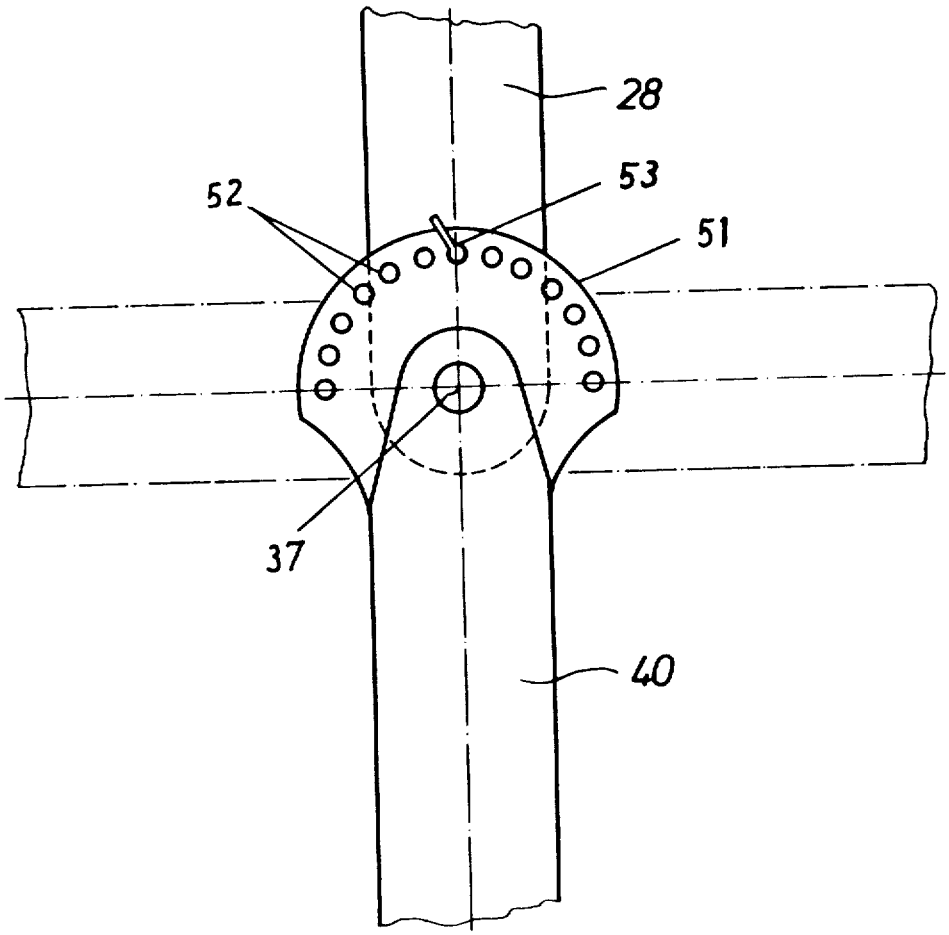
FIGS. 7 and 8 are detailed plan views of the excavator jib pivot arrangements.
Figure 8:
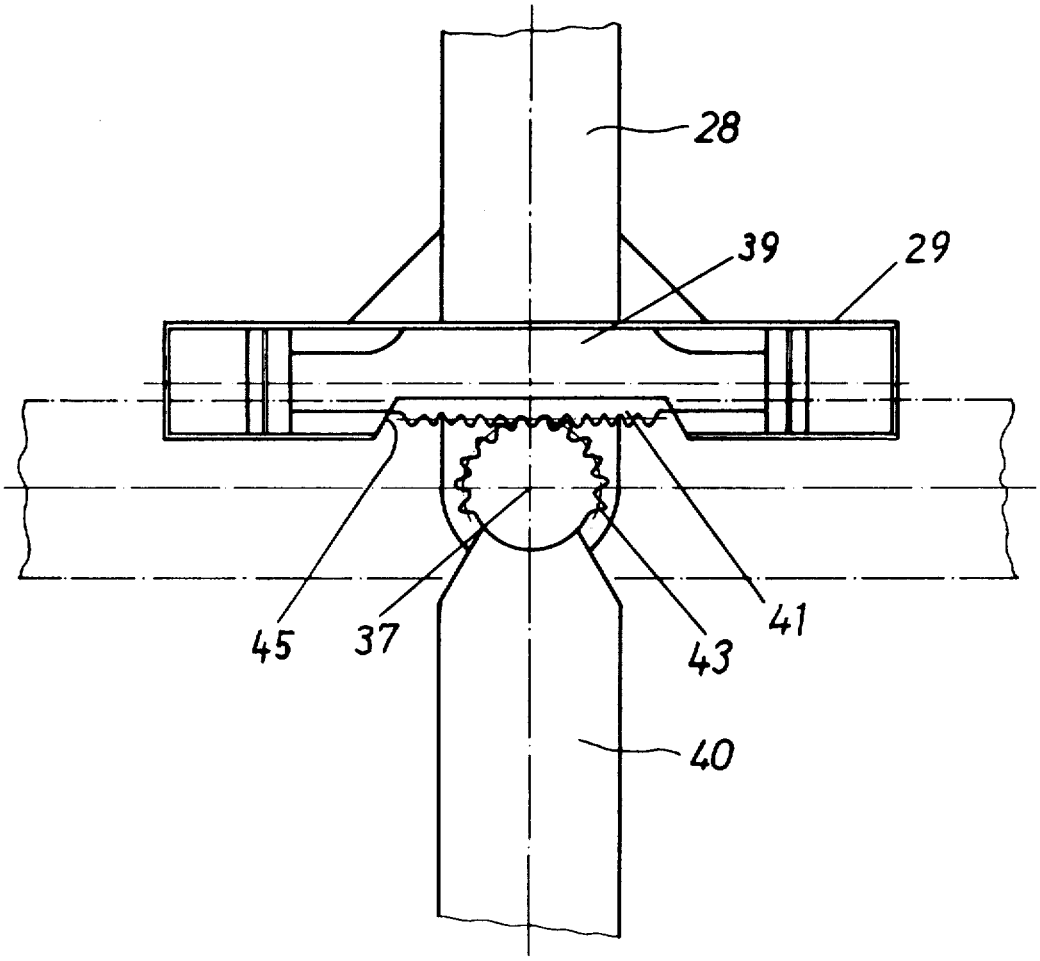

Alternative pivot arrangements are shown in FIGS. 7 and 8. In FIG. 7, the excavator jib 40 has secured to the end thereof a segment having a series of holes 52 extending over an arc of about 180°. This segment overlying the stump jib 28 serves to accommodate a locking pin 53 in one of the holes 52, with the locking pin fitting into a hole on the center line of the stump jib 28. In this manner, the stump jib 28 may be secured at any angle as defined by the holes 52 with respect to the excavator jib 40.

In FIG. 8, a further alternative is shown wherein a transversely extending cylinder 29 is secured to the stump jib 28. The piston 39 of the cylinder 29 bears a gear rack 41 which meshes with a tooth segment 43 fixed to the jib 40 in coaxial relationship to the vertical axis 37. Cylinder 29 has a lateral cutout 45 at the location of the gear rack 40. Thus hydraulic fluid pressure supplied to either side of the piston 39 will cause translation of the rack 41 and thusly rotation of the jib 40 with respect to the stump jib 28.

The operator cab 20 is at the front and on one side of superstructure 16, so that the operator, as in FIGS. 1 and 2, has free view forward to the right and left of the undercarriage parts through sight angle $\alpha$ when the work tools are folded together, for which the side pivot end position of stump jib 28 is also sufficiently far back.

Figure 5:
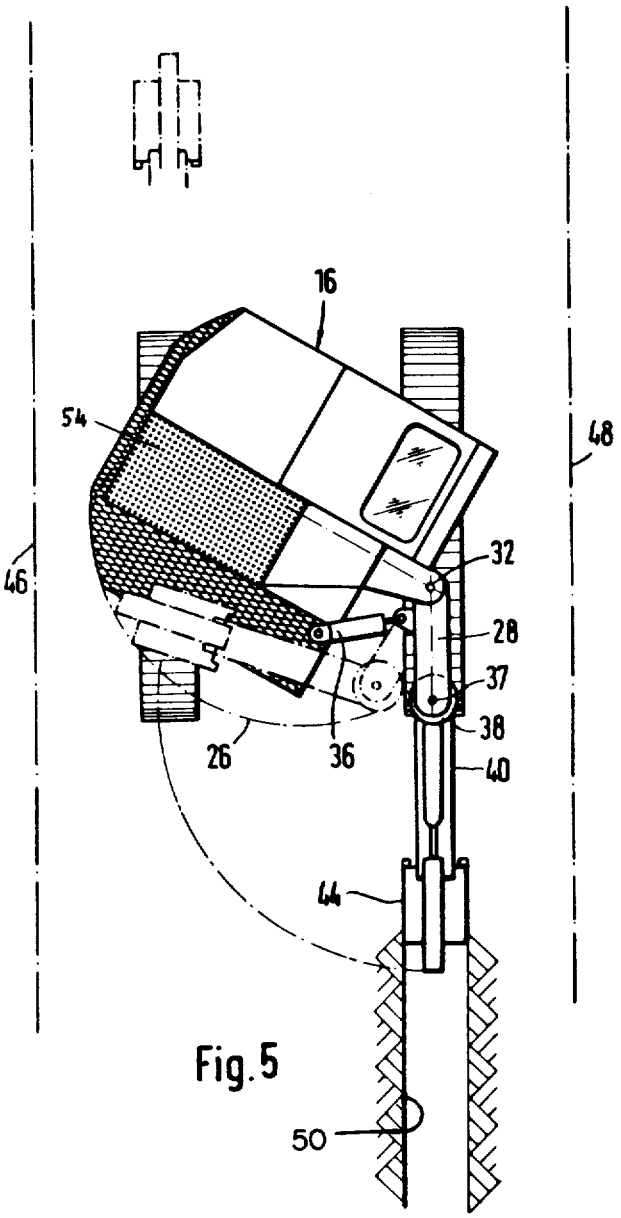
FIG. 5 is a plan view of the excavator of FIG. 1 in work position within a narrow work field within two vertical side walls.

If the digging operation, for example as in FIG. 5, is to be carried out in a work field limited by two vertical side walls 46, 48 to make a ditch 50 near wall 48, then superstructure 16 is pivoted around its axis 18 to a suitable position in which stump jib 28 and excavator 40 are found in a line. The collected excavated material is moved inward by back-pivoting of the stump jib and the excavator jib into the positions within arc 26, shown with broken lines, whereupon after pivot of superstructure 16, the shovel can be emptied rearward.

FIG. 6 shows a workplace in which a ditch is to be dug on the far side of a street edge, e.g. on the far side of guide planking or curbing (not shown). In this case, to attain efficient discharge, stump jib 28 is pivoted into its position in line with the superstructure's longitudinal axis, and the superstructure is rotated 90°, and for emptying of digging shovel 44, the superstructure is pivoted and excavator jub 40 remains in its position at an angle to stump jib 28.

Figure 4:
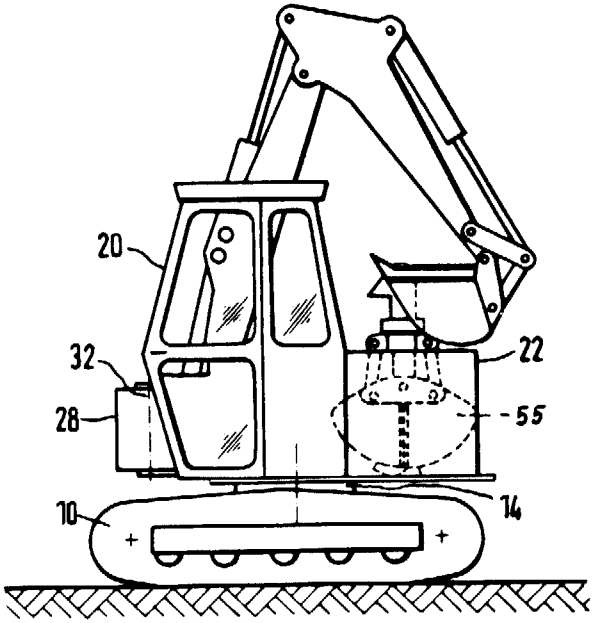
FIG. 4 is a side elevation view of the excavator of FIG. 1.
Figure 3:
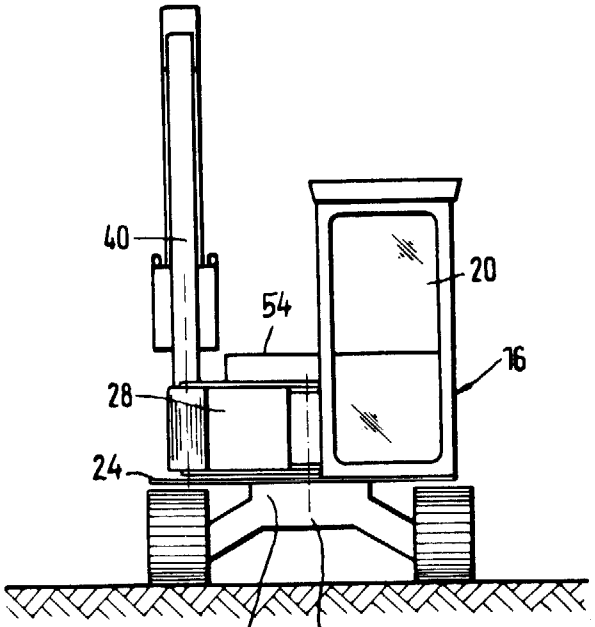
FIG. 3 is a front elevation view of the excavator of FIG. 1.

FIGS. 4 and 6 show a spare tool e.g. a grab tool 55 or wide shovel 56 set on repository platform 54, and attached there by traditional holder. The operator can change the tools from the operator's cab, for the maneuverability of excavator jib and shovel stem 44 are sufficient to reach the tools found on the repository platform.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A mobile shovel excavator having a superstructure rotatable around a vertical axis on an undercarriage, wherein the circumscribed arc of the rotating superstructure projects sidewards beyond the undercarriage, an operator cab mounted on one side of the longitudinal center line of said superstructure, a stump jib pivotable about a vertical pivot axis on said superstructure into and away from a pivot end position in which said stump jib extends substantially transverse to and on the other side of said longitudinal center line of the superstructure and within said arc, a pivot support directly connected to said superstructure for laterally pivoting said stump jib, an excavator jib being vertically and horizontally pivotable about axes on the other end of said stump jib, a repository platform on the same side of said superstructure to which said stump jib extends in its pivot end position whereby said stump jib, said excavator jib and a working tool connected thereto may be moved into said arc for full accomodation therein, and whereby said working tool may be supported on said platform when not in use and with said excavator jib substantially parallel to said longitudinal center line of the superstructure and within said arc.

2. A shovel excavator as in claim 1, wherein said repository platform is found within the outside dimensions of said undercarriage when said superstructure is positioned in the movement direction of said undercarriage.

3. A shovel excavator as in claim 1, wherein said stump jib includes a side lug and a hydraulic cylinder connecting said side lug and said superstructure.

4. A shovel excavator as in claim 1, wherein said stump jib includes a side lug and pivotally attached rod member having its outer end affixed in different pivot positions on said superstructure.

5. A shovel excavator as in claim 1, wherein said excavator jib is pivoted at the end of said stump jib by means of a pivot mechanism consisting of a hydraulic motor through at least 90° relative to the longitudinal axis of said stump jib.

6. A shovel excavator as in claim 1, 2, 3, 4 or 5 and including an operator cab at the front end on one side of the superstructure, wherein the pivot axis of said stump jib is provided so far within the circumscribed arc that the sideways pivoted stump jib outer end lies outside the sight angle between said operator cab and the front end of said undercarriage.

7. A shovel excavator as in claim 1, 2, 3, 4 or 5 and including a coping provided between said repository platform and said operator cab as an additional repository platform for wide digging tools.

* * * * *